US008146216B2

(12) United States Patent
Creager

(10) Patent No.: US 8,146,216 B2
(45) Date of Patent: Apr. 3, 2012

(54) LAMP

(76) Inventor: Craig Creager, Aurora, OH (US)

( * ) Notice: Subject to any disclaimer, the term of this patent is extended or adjusted under 35 U.S.C. 154(b) by 0 days.

(21) Appl. No.: 12/869,330

(22) Filed: Aug. 26, 2010

(65) Prior Publication Data

US 2012/0047699 A1 Mar. 1, 2012

(51) Int. Cl.
*A61G 17/00* (2006.01)

(52) U.S. Cl. ..... 27/1; 40/75; 362/154

(58) Field of Classification Search ..... 27/1; D99/5; 40/722, 725, 727, 564, 575, 606.08, 714, 40/715; 362/154, 253
See application file for complete search history.

(56) References Cited

U.S. PATENT DOCUMENTS

| | | | | |
|---|---|---|---|---|
| 1,455,902 | A * | 5/1923 | Christensen et al. | 362/132 |
| 1,859,516 | A * | 5/1932 | Keyes | 40/563 |
| 2,638,533 | A * | 5/1953 | Zobian | 362/242 |
| 2,690,552 | A * | 9/1954 | Kiibus | 340/321 |
| D345,024 | S * | 3/1994 | Fox | D26/58 |
| 5,473,525 | A * | 12/1995 | Stout | 362/412 |
| 5,598,652 | A * | 2/1997 | Nurre | 40/553 |
| 5,625,933 | A | 5/1997 | Neuberger et al. | |
| 5,644,972 | A | 7/1997 | Dahmen et al. | |
| 5,704,103 | A | 1/1998 | Crowley et al. | |
| 5,709,441 | A | 1/1998 | Bartling et al. | |
| 5,924,784 | A * | 7/1999 | Chliwnyj et al. | 362/234 |
| 6,023,822 | A | 2/2000 | Luebke | |
| 6,044,532 | A * | 4/2000 | Bowling et al. | 27/1 |
| 6,113,249 | A * | 9/2000 | Ziegler | 362/253 |
| 6,520,606 | B1 | 2/2003 | Robinson | |
| 6,665,916 | B1 | 12/2003 | Santorello et al. | |
| 6,775,886 | B2 | 8/2004 | Ogle, II | |
| 6,785,938 | B1 | 9/2004 | Johansen, Jr. | |
| 6,785,939 | B1 * | 9/2004 | James | 27/1 |
| 7,174,611 | B1 | 2/2007 | Rose et al. | |
| 7,343,653 | B2 | 3/2008 | Cunningham et al. | |
| 7,562,423 | B2 * | 7/2009 | Pryd-Kakuk | 27/1 |
| 7,627,935 | B1 | 12/2009 | Ostrum | |
| 2003/0221299 | A1 | 12/2003 | Santorello et al. | |
| 2005/0068595 | A1 | 3/2005 | Fitzgerald | |
| 2005/0185398 | A1 | 8/2005 | Scannell, Jr. | |
| 2006/0179623 | A1 | 8/2006 | Robinson | |
| 2007/0097673 | A1 * | 5/2007 | Livesay | 362/145 |
| 2007/0230197 | A1 | 10/2007 | Scannell, Jr. | |
| 2007/0268687 | A1 | 11/2007 | Scannell, Jr. | |
| 2008/0060176 | A1 | 3/2008 | Kopicki | |
| 2009/0030804 | A1 | 1/2009 | Sell | |
| 2009/0185454 | A1 | 7/2009 | Allen | |
| 2010/0102685 | A1 | 4/2010 | Ward | |

* cited by examiner

*Primary Examiner* — William L. Miller
(74) *Attorney, Agent, or Firm* — Calfee, Halter & Griswold, LLP

(57) ABSTRACT

An urn for storage of ashes having a container and a lighting assembly. The container defines an internal chamber adapted for storage of ashes. The lighting assembly is fixed to the container and includes a hollow sleeve extending from the container, a light bulb socket mounted on an end of the sleeve, and electrical wiring having a first end connected to the light bulb socket and routed along a path within the sleeve, into the chamber and out of the chamber. A manual switch is included for controlling electricity flow to the light bulb socket. A second end of the electrical wiring terminates at an electrical plug adapted for connection to an electricity source.

19 Claims, 4 Drawing Sheets

LAMP

BACKGROUND

Pets are kept and appreciated by owners for many reasons, including protection, companionship, recreation and family interaction. After a pet's life has ended, an owner frequently takes action to remember and pay honor to the pet. Cremation retention of the ashes is a memorial object are several steps that an owner may take.

A pet owner may chose to retain a pet's ashes in a small urn or other container. As a temporary or permanent resting place, urns can be placed on shelves, mantles, bookcases, or other locations within an owner's home. Certain pet owners desire a more safe and unique location to store the ashes of his or her pet. Others may hold similar desires for the ashes of family members.

SUMMARY OF THE INVENTION

In an illustrated embodiment of the invention, a urn includes an electrical light source and a storage chamber for valuables. The urn may include a lamp, proper electrical wiring for an electrical light bulb, and a storage area suitable for pet ashes or a pet urn.

BRIEF DESCRIPTION OF THE DRAWINGS

Features and advantages of the invention will become apparent from the following detailed description made with reference to the accompanying drawings.

DETAILED DESCRIPTION OF THE INVENTION

Figure 1:
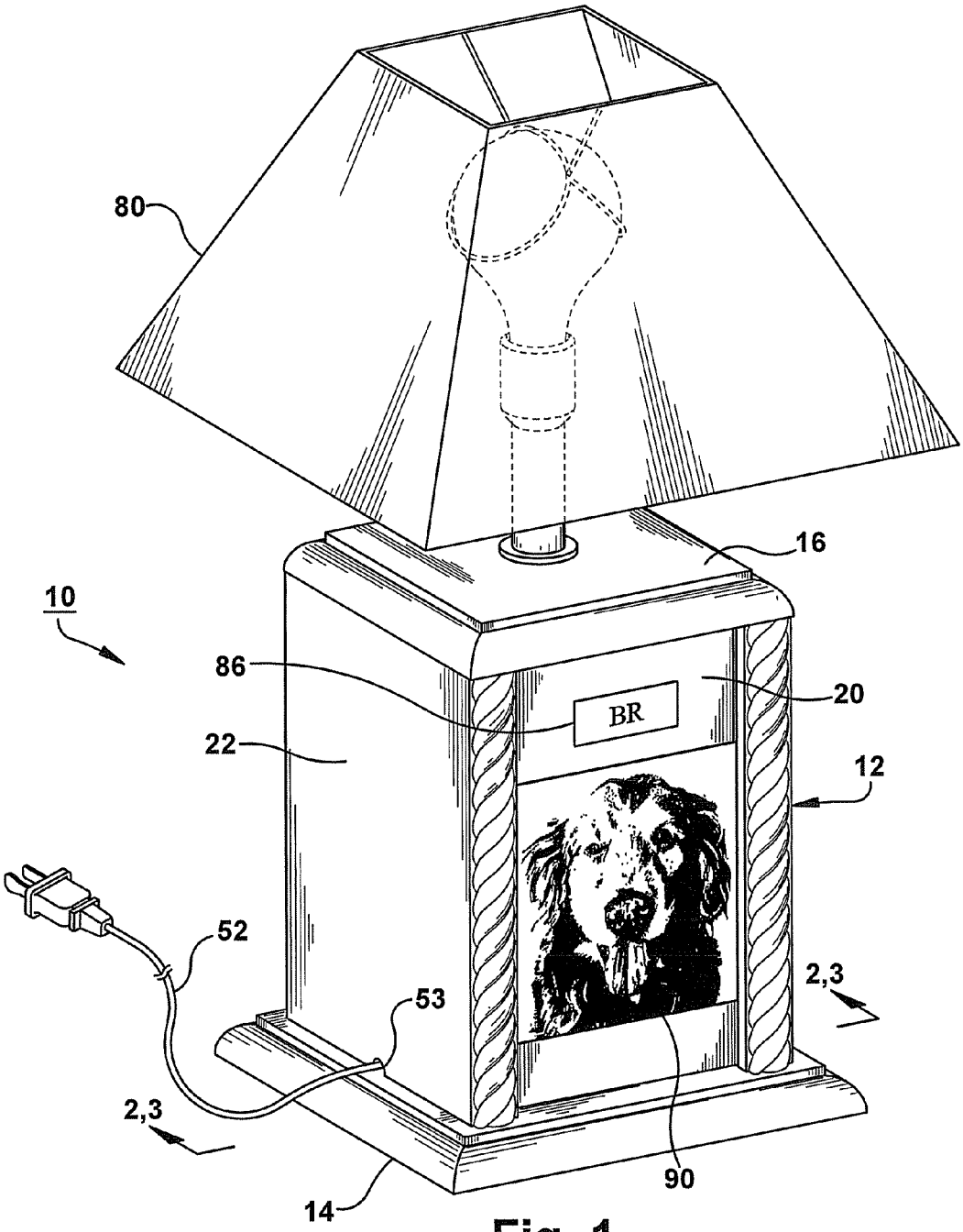
FIG. 1 is a front perspective view of an urn.

The Detailed Description of the Invention merely describes preferred embodiments of the invention and is not intended to limit the scope of the invention in any way. Indeed, the invention as described by the claims is broader than and unlimited by the preferred embodiments, and the terms used have their full ordinary meaning.

According to an inventive aspect of the present application, an urn includes a container defining an internal chamber and a lighting assembly. The chamber may be used to store valuables and keepsakes. The chamber may function as an urn to store ashes, such as pet ashes or human ashes, or it may function as a storage area for containers, such as a pet urn. The chamber may be essentially secured upon assembly, or it may be user accessible, such as by opening a door or lid by operation of a key-operated lock cylinder or a combination. The chamber may also be accessible by partial disassembly of the container, such as for example, by removal of only a base from the container to gain access to the chamber. In a preferred embodiment, the urn is suitable for use as a table lamp, but the present invention can be practiced with other type of lamp assemblies, such as for example, a floor lamp.

Referring now to the drawings, FIGS. 1-4 illustrate an exemplary urn 10. These Figures include aspects and features of the preferred embodiment, but are not meant to limit the scope of the invention in any way. Further, it should be apparent to one with ordinary skill in the art that the present invention can be practiced with an urn having a variety of dimensions, components, ornamental features and structure.

A front perspective view of an exemplary urn 10 is shown in FIG. 1. The urn 10 includes a container 12 and a lighting assembly fixed to, and having components integrated with, the container. The container 12 is constructed of a base 14, at least one side portion, and a top 16. As shown, the container components are constructed of wood in the preferred embodiment, but may also be made of any suitable material, such as for example, ceramic, plastic, metal or glass. Likewise, the components may be assembled by any suitable known construction method, such as for example, glue, adhesives, or mechanical hardware, such as for example, screws or nails. The components may include tongues, grooves, slots, or other structure to aid in the assembly of the container 12.

Figure 4:
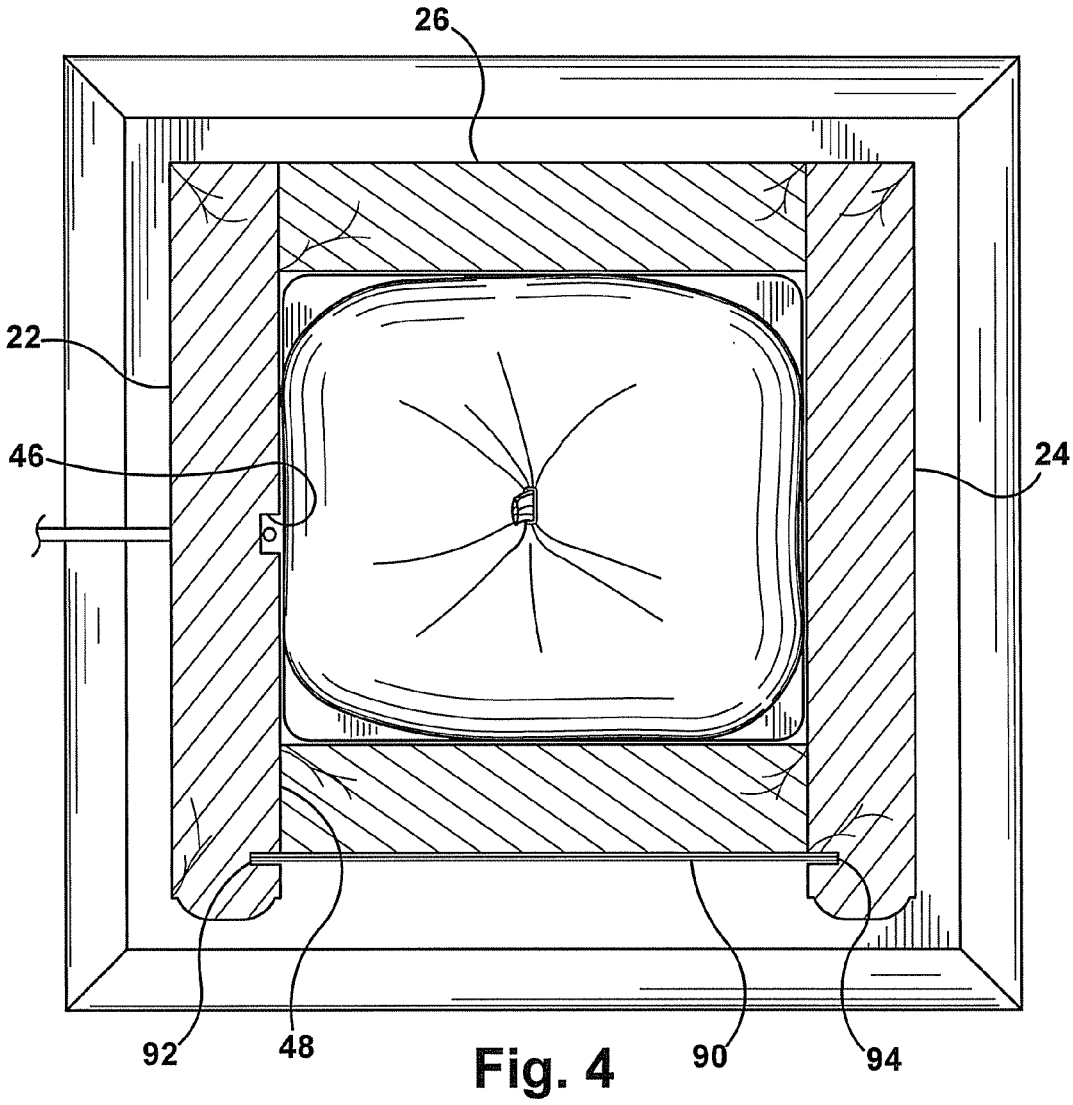
FIG. 4 is a top sectional view of the urn of FIG. 1, shown along the line 4-4 of FIG. 3.

As shown, the base 14 has a horizontal footprint larger than the main body of the container 12, formed by the side portions. The base 14 can be square in cross-sectional shape as shown in FIG. 4 with beveled edges, or may be a different shape, such as for example, rectangular, circular, oval, or polygonal. Further, the base 14 may have structure for mounting to a surface, and may include a separate internal chamber for storage or locking of valuables. The interior of the base may be visible from the outside and include lighting to illuminate stored materials.

The container 12 has a main body formed by four side portions, a front portion 20, right and left portions 22, 24 and a back portion 26. As discussed, the side portions 20, 22, 24, 26 are assembled with the base 14 and top 16 by any known construction technique. The front portion 20 extends vertically from the base 14 in a parallel orientation with the back portion 26, as likewise the right portion 22 extends vertically from the base 14 in a parallel orientation with the left portion 24. In the practice of the invention, the number of side portions may vary, as may the cross-sectional shape of the container 12, such as for example, rectangular, circular, oval, or polygonal.

Figure 3:
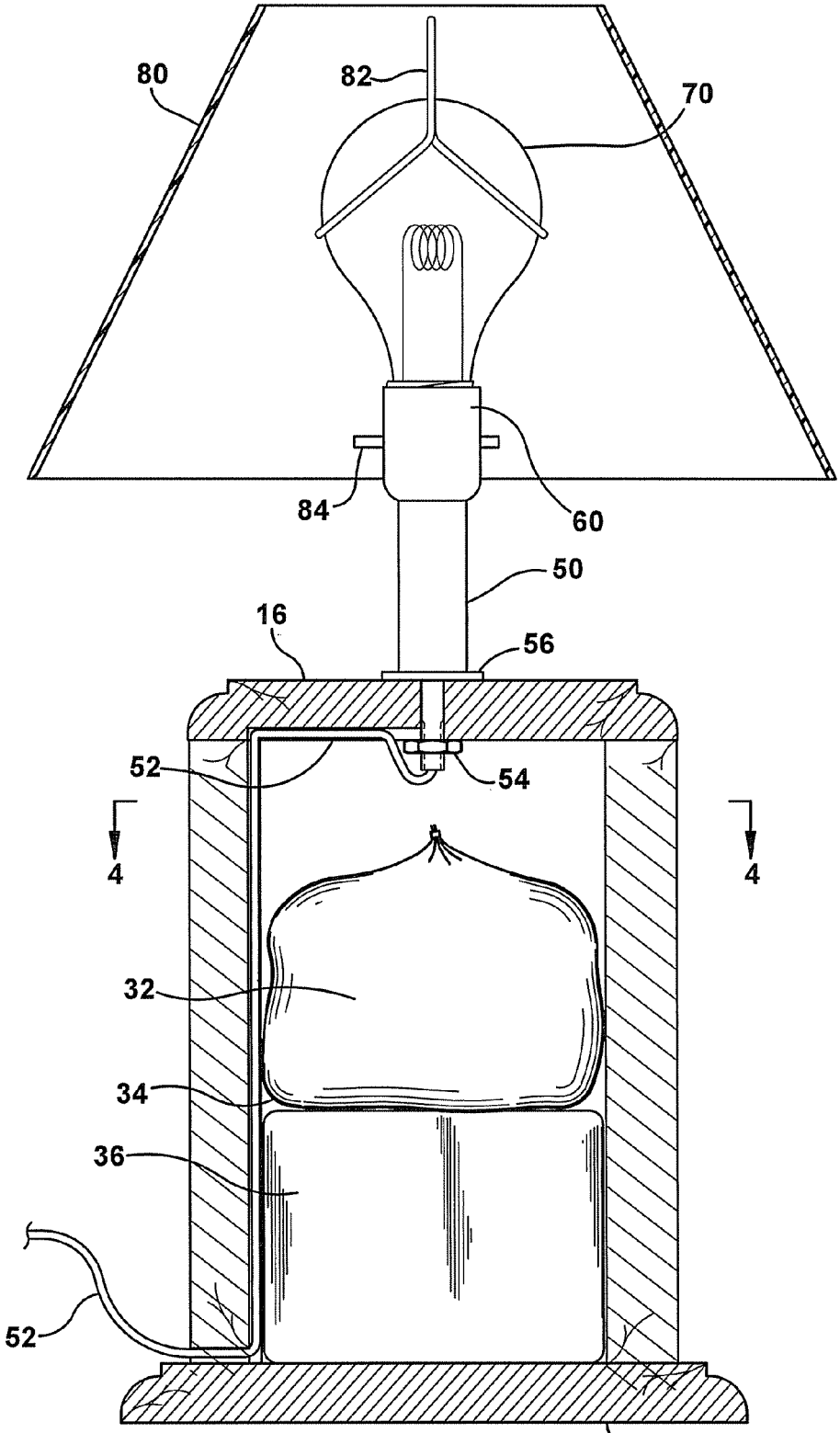
FIG. 3 is a front sectional view of the urn of FIG. 1, shown along the line 2-2 of FIG. 1.

As assembled, the container 12 defines an internal chamber 30 suitable for storage of ashes, such that the internal chamber 30 may act as an urn. The size and dimensions of chamber 30 may vary in the practice of the invention to accommodate various amounts of ash. As shown in FIG. 3, an amount of ash 32 may be container in a container 34, such as for example, a plastic bag, jar, box or by other suitable means. As discussed, the internal chamber 30 is formed by the inside facing surfaces of six components. The shape and size of the components may vary in the practice of the invention. The internal chamber 30 may include one or more foam inserts 36 to absorb weight or to stabilize items within the chamber 30, such as for example, a ceramic urn. The external surfaces of the components may be decorated in an ornamental fashion, such as for example, stained, painted or milled to include ornamental features.

Figure 2:
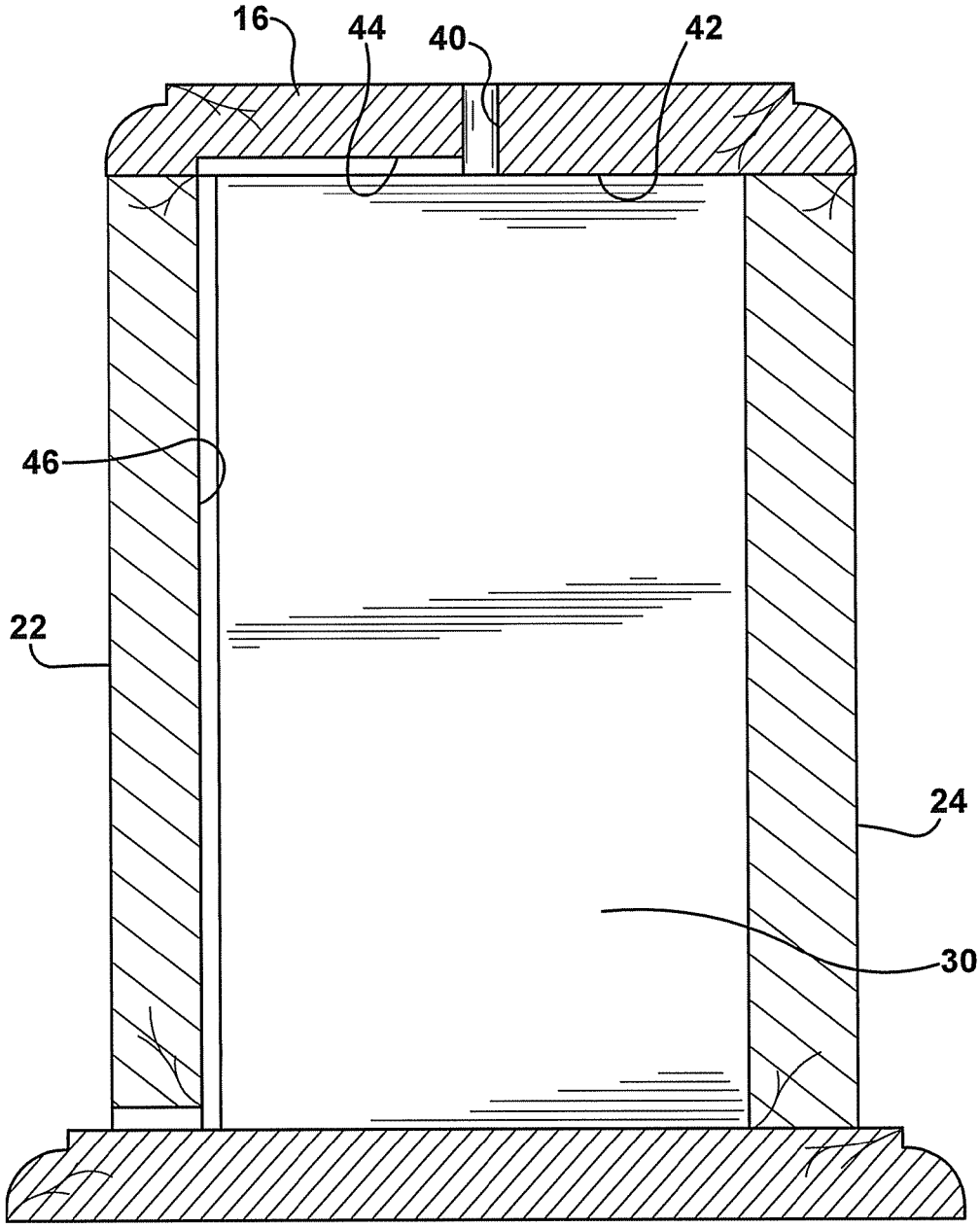
FIG. 2 is a front sectional view of the urn of FIG. 1, shown along the line 2-2 of FIG. 1 with lighting assembly components removed.

A front sectional view of the urn 10, shown along the line 2-2 of FIG. 1, is shown in FIG. 2 with the lighting assembly components removed for discussion of the container 12. The components of the container 12 include features advantageous to assembly of the lighting assembly components with the container 12. To be discussed later in great detail, a first aperture 40 extends through the top 16 for mounting of a sleeve 50. The internal surface 42 of the top 16 defines a first groove 44 extending from the first aperture 40 toward on outer edge of the top. As shown in FIG. 3, electrical wiring within the chamber is disposed within the first groove 44 as it is routed toward a second groove 46 defined by the internal surface 48 of the right portion 22. The second groove is best seen in FIG. 4. The second groove 46 runs the height of the right portion 22 and exits the chamber 30 at a second aperture 53 through the bottom surface of the right portion 22. FIG. 1 illustrates an electrical cord extending through the second aperture 53.

A lighting assembly is integrated with the container 12 in the sectional view of the urn 10 shown in FIG. 3. A hollow sleeve 50 is fixed to the top 16 and extends upward from the top 16 in a direction away from the base 14. A stem of the sleeve extends through the first aperture 40 such that a nut 54 and washer 56 are arranged on either side of the top 16 to secure the sleeve to the top 16. In a preferred embodiment, the cord 52 is routed through the apertures 40, 53 prior to final assembly of the container 12. After final assembly, electrical wiring originates at a light bulb socket 60 mounted on a distal end of the sleeve 50 and terminates at an electrical plug 62 adapted for connection to an electricity source, such as for example, a wall socket or multiple-socket power strip.

A conventional light bulb 70 may be removably secured in the bulb socket 60. As illustrated, a lamp shade 80 is positioned above and remote from the container 12 by a wire spring 82 secured to the light bulb 70. The lamp shade 80 may be in a variety of shapes, size, colors and materials in the practice of the invention. The lamp shape may include a mounting location for placement of a picture, such as for example, a photograph of a pet memorialized by the urn. A user may control electricity flow to the light bulb socket 60 by operation of a manual switch 84. The switch can be a stem switch as illustrated, a pull cord switch, or any known switch in the art. Further, the switch 84 can alternatively be located on the cord 52 outside of the internal chamber 30.

The exemplary urn 10 includes several features allowing the owner to personalize the urn, thereby making the memorial process more unique. The base may include a mounting location for indicia, such as for example, a plate with the subject pet's name. In FIG. 1, a plate 86 is fixed to the exterior surface of the front portion 20. A picture of the memorialized pet can also be attached to the urn 10. FIG. 1 shows a picture 90 disposed on the exterior surface of the front portion 20. As best seen in FIG. 4, either end of a photograph is inserted within a vertical slot 92, 94. The vertical slots 92, 94 are opposing and spaced apart, and extend the height of the side portions 22, 24, respectively. As arranged, a photograph 90 may be inserted in a convex orientation and then spring in place to a flat orientation within the slots 92, 94. As best illustrated in FIGS. 1 and 4, the front portion 20 is disposed in a recessed orientation between the side portions 22, 24 to provide a framing effect for the picture 90.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions (such as alternative materials, structures, configurations, methods, circuits, devices and components, software, hardware, control logic, alternatives as to form, fit and function, and so on) may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

What is claimed is:

1. An urn for storing ashes of a deceased, said urn comprising:

a container defining an internal chamber adapted to store said ashes, said container having a base portion, at least one vertically extending side portion, and a top portion;

a lighting assembly fixed to said container, said assembly having a hollow sleeve extending from said top portion in a direction away from said base portion, a light bulb socket mounted on a distal end of said sleeve, electrical wiring having a first end connected to said light bulb socket and routed along a path within said sleeve, into said chamber and out of said chamber; and a manual switch for controlling electricity flow to said light bulb socket;

wherein a second end of said electrical wiring terminates at an electrical plug adapted for connection to an electricity source;

further wherein an internal surface of said top portion defines a first groove, wherein said electrical wiring within said chamber is disposed at least in part within said first groove.

2. The urn of claim 1 further comprising a light bulb installed in said light bulb socket and a lamp shade removably fixed to said light bulb and remote from said container.

3. The urn of claim 1 further comprising a plate fixed to an exterior surface of said container, wherein said plate includes indicia related to the origin of said ashes stored within said chamber.

4. The urn of claim 1 further comprising a photograph disposed on an exterior surface of said container.

5. The urn of claim 1 wherein an internal surface of said at least one vertically extending side portion defines a second groove, wherein said electrical wiring within said chamber is disposed at least in part within said second groove.

6. The urn of claim 1 wherein said container comprises four vertically extending side portions.

7. The urn of claim 6 wherein one of said four vertically extending side portions is disposed between two of said four vertically extending side portions in a recessed orientation.

8. The urn of claim 7 wherein each of said two of said four vertically extending side portions includes a vertical slot, wherein said vertical slots are opposing and spaced apart, such that either end of a photograph is disposed within one of said vertical slots to arrange said photograph on an external surface of said urn.

9. The urn of claim 6 wherein said top portion, said four vertically extending side portions and said base portion are constructed of wood.

10. The urn of claim 1 further comprising a locking mechanism to prohibit unauthorized entry into said container.

11. An urn for storing ashes of a deceased, said urn comprising:

a container defining an internal chamber adapted to store said ashes, said container having a base portion, four vertically extending side portions, wherein one of said four vertically extending side portions is disposed between two of said four vertically extending side portions in a recessed orientation, and a top portion;

a lighting assembly fixed to said container, said assembly having a hollow sleeve extending from said top portion in a direction away from said base portion, a light bulb socket mounted on a distal end of said sleeve, electrical wiring having a first end connected to said light bulb socket and routed along a path within said sleeve, into said chamber and out of said chamber; and a manual switch for controlling electricity flow to said light bulb socket;

wherein a second end of said electrical wiring terminates at an electrical plug adapted for connection to an electricity source.

12. The urn of claim 11 further comprising a light bulb installed in said light bulb socket and a lamp shade removably fixed to said light bulb and remote from said container.

13. The urn of claim 11 further comprising a plate fixed to an exterior surface of said container, wherein said plate includes indicia related to the origin of said ashes stored within said chamber.

14. The urn of claim 11 further comprising a photograph disposed on an exterior surface of said container.

15. The urn of claim 11 wherein an internal surface of said top portion defines a first groove, wherein said electrical wiring within said chamber is disposed at least in part within said first groove.

16. The urn of claim 15 wherein an internal surface of said at least one vertically extending side portion defines a second groove, wherein said electrical wiring within said chamber is disposed at least in part within said second groove.

17. The urn of claim 11 wherein each of said two of said four vertically extending side portions includes a vertical slot, wherein said vertical slots are opposing and spaced apart, such that either end of a photograph is disposed within one of said vertical slots to arrange said photograph on an external surface of said urn.

18. The urn of claim 11 wherein said top portion, said four vertically extending side portions and said base portion are constructed of wood.

19. The urn of claim 11 further comprising a locking mechanism to prohibit unauthorized entry into said container.

* * * * *